US006070824A

United States Patent [19]

Du Pont

[11] Patent Number: 6,070,824

[45] Date of Patent: Jun. 6, 2000

[54] METHOD AND APPARATUS FOR MANIPULATING LARGE SECTIONS OF ARTIFICIAL TURF

[75] Inventor: Jacques M. Du Pont, Austin, Tex.

[73] Assignee: Southwest Recreational Industries, Inc., Leander, Tex.

[21] Appl. No.: 08/928,304

[22] Filed: Sep. 12, 1997

Related U.S. Application Data

[60] Provisional application No. 60/026,583, Sep. 18, 1996.

[51] Int. Cl.[7] ..... B65H 75/30; B65H 16/02

[52] U.S. Cl. ..... 242/393; 242/595.1; 242/615.11; 242/919

[58] Field of Search ..... 242/548.3, 566, 242/615.3, 595.1, 542, 393, 919, 615.11; 294/81.5, 81.1, 81.56; 4/498, 499, 502; 406/86; 414/676; 473/504

[56] References Cited

U.S. PATENT DOCUMENTS

| | | | |
|---|---|---|---|
| 3,099,444 | 7/1963 | Burt . | |
| 3,108,804 | 10/1963 | Wagner . | |
| 3,517,892 | 6/1970 | Laird et al. . | |
| 3,642,222 | 2/1972 | Leysinger . | |
| 4,037,769 | 7/1977 | Meyers . | |
| 4,289,090 | 9/1981 | Bagby et al. . | |
| 4,312,504 | 1/1982 | Ritedge et al. | 272/3 |
| 4,399,954 | 8/1983 | Arrant . | |
| 4,444,364 | 4/1984 | Dahl et al. . | |
| 4,463,911 | 8/1984 | Beach . | |
| 4,565,337 | 1/1986 | Mondini et al. . | |
| 4,588,189 | 5/1986 | Arrant | 273/27 |
| 4,738,407 | 4/1988 | Arrant . | |
| 4,815,926 | 3/1989 | Chaffee et al. . | |
| 4,955,092 | 9/1990 | Hagan . | |
| 5,456,566 | 10/1995 | Kniley et al. | 414/546 |

*Primary Examiner*—Donald P. Walsh
*Assistant Examiner*—William A. Rivera
*Attorney, Agent, or Firm*—Miller & Martin LLP

[57] ABSTRACT

A method and apparatus for manipulating large sections of artificial turf for the removable covering of a smooth, rigid surface such as a floor, with a large section of artificial turf which involves pulling it across the surface while supported on a pneumatic cushion to minimize frictional drag and then relieving the cushion after the section is in place to allow it to settle onto the surface. The apparatus comprises powered rollers for supporting a roll of the turf, said roll being prevented from significant horizontal motion upon the rollers by thrust bearing block members, rope-like members for attachment along a truss-like spar removably attached along the leading margin of the roll, recessed winches for pulling such rope-like members across a supporting pup-up roller assembly, motor speed controls for adjusting the rate of such rolling or unrolling, and a detachable blower and air transmission duct for developing the air cushion between the turf and rigid surface.

27 Claims, 5 Drawing Sheets

METHOD AND APPARATUS FOR MANIPULATING LARGE SECTIONS OF ARTIFICIAL TURF

The priority of U.S. Provisional Application Ser. No. 60/026,583, filed Sep. 18, 1996 is claimed.

BACKGROUND OF THE INVENTION

This invention relates to an improved method and apparatus for manipulating large sections of artificial turf and the artificial turf installation per se during manipulation, and more specifically to an improved method and apparatus facilitating repeated covering and uncovering of a rigid surface with such turf.

Artificial turf installations have become quite widespread for indoor and outdoor uses. In a typical convertible indoor artificial turf installation, rectangular-shaped sections of artificial turf have been installed to removably cover a support surface. The turf sections may be repeatedly rolled up and stored after each use so that the area underneath can be used for other purposes. For example, such a convertible system has been used to manually cover a basketball floor with synthetic turf where it is used for football practice and then manually rolled up and stored nearby in large rolls to expose the floor for use in playing basketball. Aside from the need for extensive manpower to roll out and roll up the large sections of artificial turf, the drawback to this approach is the lack of an effective way to manipulate the large artificial turf area to remove wrinkles which developed during the roll-up and roll-out phases.

Significant improvements are disclosed in U.S. Pat. Nos. 4,399,954 and 4,738,407, incorporated herein by reference, which disclose the manipulation of large sections of artificial turf supported on a pneumatic cushion. To cover a field, the artificial turf is pulled from a roll of artificial turf supported along its length by support rollers. For instance, artificial turf sufficient to cover an entire football field can be pulled from the roll because friction between the artificial turf and the support surface is minimized with a pneumatic cushion, provided by a blower feeding low pressure air to a few ports installed in the surface in a row adjacent the roll, which is often stored below grade in a large covered pit. When the field is extended, the blower is shut down, allowing the artificial turf to settle onto the support surface. The artificial turf can be rapidly removed by applying a pneumatic cushion then winding the artificial turf onto the roll, for instance by driving the support rollers.

Such a rapid field conversion system has benefited the management of multi-use stadia by allowing the scheduling of events more closely together to maximize facility use. For instance, a football game can be played on artificial turf supported over a basketball court the same day as a basketball game due to the minimal time required for field conversion, often less than one hour.

Another significant improvement is disclosed in U.S. Pat. No. 4,588,189, incorporated herein by reference, which discloses the manipulation of large, irregularly shaped sections of artificial turf supported on a pneumatic cushion by utilizing an apparatus comprising at least one belt removably attached to an oblique margin of the artificial turf to provide non-deflecting support for a roll of artificial turf wrapped onto an elongated cylindrical pole.

A principal disadvantage of such rapid field conversion systems is that their components occupy valuable space within the facility which could be more efficiently utilized.

Another disadvantage of such systems was the lack of a means for protecting the rope-like members used to roll and unroll the turf sections from the damaging effects of friction with the floor and other support surfaces.

Similarly, heretofore, the pneumatic means for developing low air pressure underneath the artificial turf required installation below ground level of an air blower or air transmission ducts.

Another disadvantage of such rapid field conversion systems is that the cylindrical core on which the turf is rolled and stored may shift horizontally during winding and unwinding, resulting in harmful stresses upon the artificial turf and elongation of the roll of turf as it is rolled and unrolled. Such elongation of the roll may interfere with the proper operation of the system or result in misalignment of the turf when covering the desired surface.

Finally, current rapid field conversion systems have no means for adjusting the rate of rolling and unrolling the artificial turf. This can result in undesirable stresses upon the turf and other components of the apparatus when sudden jolts are encountered during the commencement and termination of rolling.

Thus, a need exists in the prior art for an improved system to conveniently manipulate large sections of artificial turf in a convertible installation involving multiple coverings and uncoverings of a rigid support surface.

SUMMARY OF THE INVENTION

The present invention minimizes or eliminates altogether the disadvantages discussed in the preceding paragraphs. Accordingly, it is an object of this invention to provide an improved method and apparatus facilitating the manipulation of large sections of artificial turf during the temporary covering and uncovering of a relatively smooth, rigid support surface.

Another object is to provide an improved artificial turf product installation which minimizes frictional drag between the artificial turf and the support surface during the covering and uncovering operation.

Another object is to provide an improved artificial turf product installation having protection for the rope-like members from the damaging effects of friction with the support surface.

Another object of the present invention is to provide an improved artificial turf installation apparatus whose components are uniquely housed so as to minimize interference with the efficient use of space within the host facility.

Another object of the present invention is to provide an improved artificial turf installation apparatus which minimizes the stresses applied to a section of artificial turf as it is being repeatedly rolled and unrolled over a supporting surface.

These and other objects are accomplished by providing portable air transmission ducts rather than ducts built into the floor of the facility.

These and other objects are accomplished by providing winches which may be placed below floor level in recessed pits which may be covered with a removable lid, said pit being fitted with a roller which may be raised upon removal of the lid, thereby allowing the guide rope or cable to smoothly access the winch. The invention also provides a shallow spar trench having a removable cover into which the spar may be placed while the turf is being used.

A truss-like spar member may be releasably connected along the leading margin of the turf roll which is stronger yet lighter in weight than the spar members heretofore used in connection with artificial turf installation apparatus. The spar may comprise a lightweight tubular truss which, alternately, may be comprised of removable sections.

These and other objects are also accomplished by providing a pit cover which, after initial installation of the apparatus, may be semi-permanently affixed in a closed position, said pit cover having a hinged outer section which may then be used to access the pit and roll or unroll the turf. The pit covers and lids may be provided with hydraulic torsion arm assemblies which aid in lifting the cover and are self-locking in the open position, thereby preventing an open lid from accidentally closing, even in the event of hydraulic failure.

These and other objects are also accomplished by providing a thrust bearing block at each end of the cylindrical core which prevents the core from significant horizontal movement during rolling and unrolling of the turf. Motor speed control mechanisms are also used to allow adjustment of the rate of rolling and unrolling of the turf to allow ramping of the speed of winding and unwinding as convenient, thereby eliminating stressful jolts which are common upon the start-up and stopping of rolling and unrolling.

Other objects of this invention will in part be obvious and will in part appear from the following description and claims.

DETAILED DESCRIPTION OF THE DRAWINGS

Figure 2:
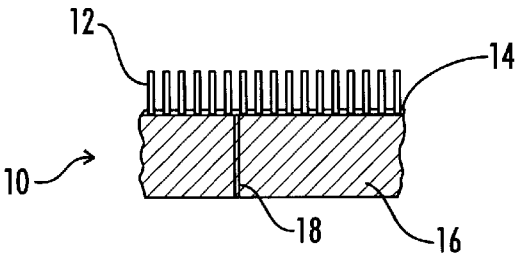
FIG. 2 is a side cross-sectional view in enlarged form of the artificial turf of FIG. 1.

Referring now to the drawings, FIG. 2 shows substantially impervious, heavy duty artificial turf 10 which comprises pile 12 in the form of ribbons of synthetic thermoplastic material such as nylon, polypropylene or the like, knitted, tufted or woven or otherwise secured in a backing 14 to which an underlay in the form of resilient pad 16 comprising a foam structure is laminated, such as by means of a suitable adhesive, or generated by foaming in place. Artificial turf 10 may optionally have narrow vent channels 18 randomly sparingly locally formed in turf 10 through its thickness, as by piercing with a sharp member such as a pencil-like element, for a purpose to be described. Artificial turf 10 is a heavy duty material capable of repeated wear resistant use weighing between about 0.2 to about 3.5 pounds per square foot of surface area, and typically from about 0.4 to about 1.75 pounds per square foot of surface area. Artificial turf 10 must be substantially impervious in order to hold the air cushion to be described across its expanse during manipulation according to the invention. Depending on the use, however, pad 16 may be dispensed with, certain constructions of turf without pad providing an adequate barrier as to be usable in the invention such as wherein pile 12 is tufted into backing 14. Also, with otherwise pervious forms of turf, pad 16 could be replaced with other members such as a flexible film, sheet, mat or the like to provide the necessary barrier to the air cushion.

Figure 1:
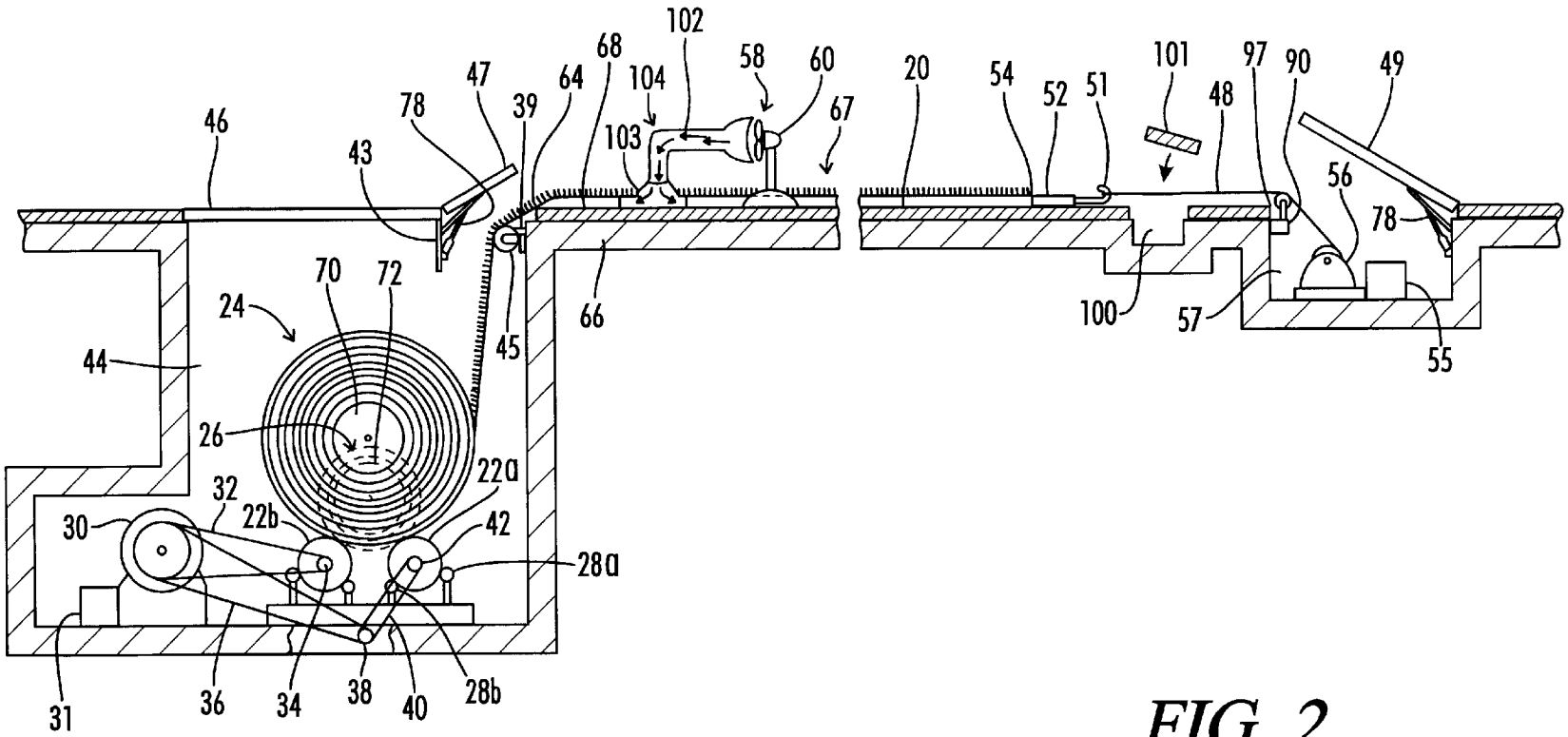
FIG. 1 is a schematic view of an installation apparatus embodying the present invention.

Apparatus is shown in FIG. 1 for covering rigid, relatively smooth, horizontal surface 20 such as a hardwood or concrete floor with a large section 67 of substantially impervious, heavy duty, artificial turf 10 having margins. Such apparatus comprises a pair of laterally spaced powered drive rollers 22*a* and 22*b* having a length perpendicular to the plane of FIG. 1 about the same as that of roll 24. Rollers 22*a* and 22*b* are supported for rotation by smaller diameter, journal mounted support wheel pairs 28*a* and 28*b* spaced along rollers 22*a* and 22*b* to reduce bending of the latter. Depending on the weight of turf roll 24, further support roller pairs may be provided. In this regard, roll 24 when fully wound is typically on the order of about four to about eight feet in diameter and extends lengthwise perpendicular to the plane of FIG. 1 from between about 35 to about 360 feet, typically from between about 160 to about 260 feet. Each drive roller 22*a* and 22*b* for this size of roll 24 is in the form of a pipe about eight inches in diameter, and of a length slightly longer than the roll, though the diameter and length of such drive rollers 22*a* and 22*b* may vary from this depending on the size of turf roll 24. The lateral distance between opposite members of each drive roller pair 22*a* and 22*b* is set so that after unwinding turf roll 24 to the desired extent, the final unwound diameter is such that the roll will not fall between a roller pair 22*a* and 22*b*. The unwound roll is shown in phantom at 26 as still resting on roller pair 22*a* and 22*b*. Said unwound roll 26 comprises floating steel core 70, which is typically about twenty-four inches in diameter, and the attached trailing end 72 of the turf. Trailing end 72 may be attached to core 70 by retaining means such as in the form of one or two windings of turf when the floor is fully covered.

Figure 3:
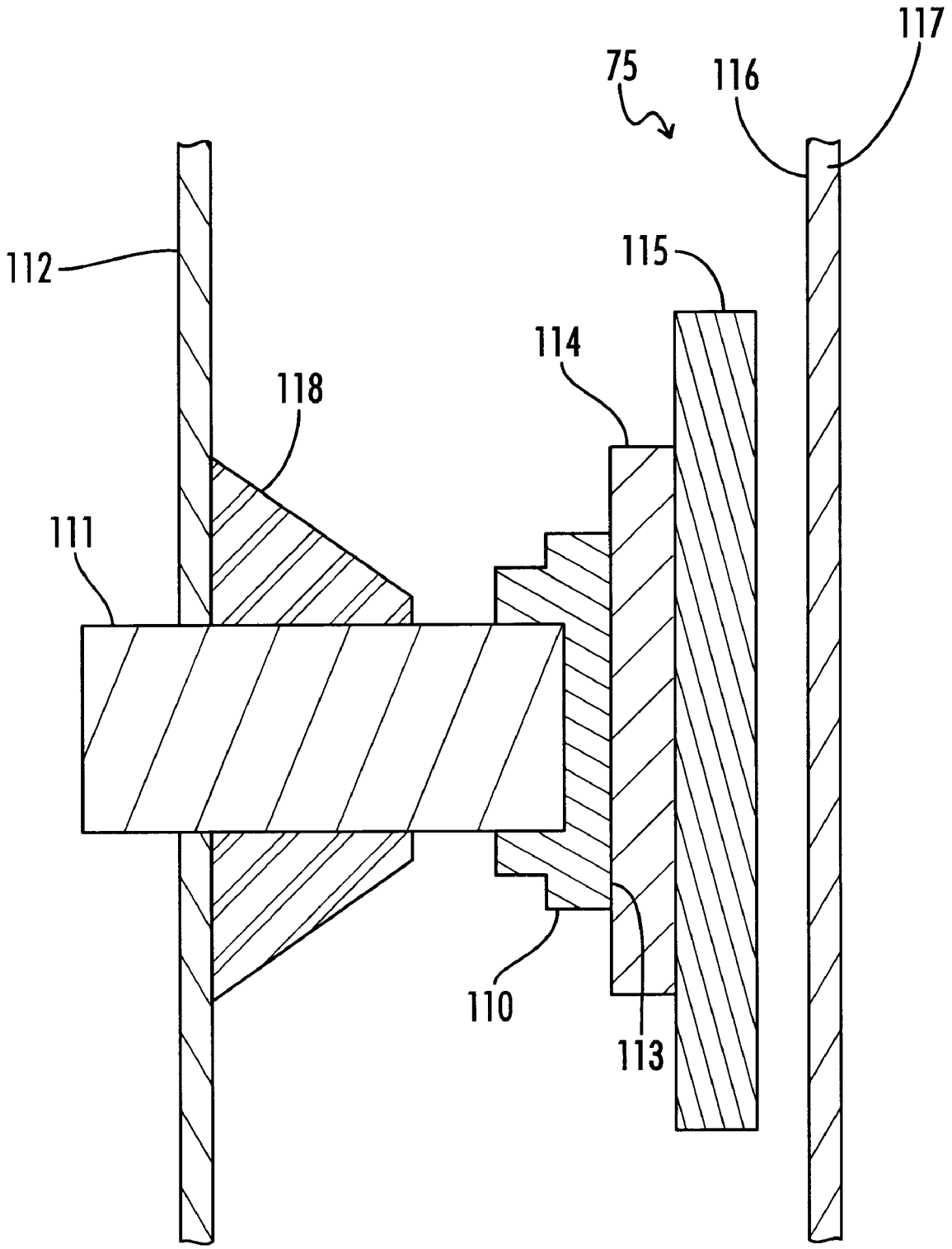
FIG. 3 is a side cross-sectional view of the thrust bearing assembly according to the present invention.

A pair of opposing thrust bearing blocks (not shown in FIG. 1) are positioned adjacent to each end of the core 70 to prevent significant horizontal movement of the core 70 or roll 24, as the case may be, during winding and unwinding. As shown in FIG. 3, the thrust bearing block 75 comprises idler frame 117 and thrust bearing 110 attached to center shaft 111 welded to end plate 112 of core 70. Shaft 111 is buttressed on all sides by gusset 118 which is also welded to end plate 112. Thrust bearing 110 is preferably a conventional thrust bearing which clamps onto shaft 111 but allows the shaft to freely rotate 360° as well as allowing slight play in the alignment of the shaft. Attached to the rear face 113 of thrust bearing 110 is a face plate 114 having a replaceable wear plate 115 removably connected opposite thrust bearing 110. The wear plate 115 is preferably constructed from a durable plastic such as nylon and provides a slidable contact surface against the face 116 of idler frame 117. The face 116 of idler frame 117 has a height and width sufficient to maintain contact with wear plate 115 as it is carried vertically in tandem with the floating core, the core rising and falling as the size of the roll increases and decreases. Idler frames 117 must be of sufficiently sturdy construction to retain a full roll of turf upon the rollers 22*a* and 22*b* (not shown in FIG. 3). Preferably, a space of ⅛ to ¼ inch is provided between each wear plate 115 and idler frame 117 when the core 70 is initially centered upon rollers 22*a* and 22*b* (not shown). Thus it can be seen that the roll 24 is prevented from significant horizontal movement upon the rollers 22*a* and 22*b* (not shown) because of the centering force on the core 70 provided by idler frames 117.

Returning then to FIG. 1, motive power may be provided in the form of conventional electric motor 30 operatively connected via optional, associated power transmission linkage, not shown, and transmission belt 32 to drive roller shaft 34 and cause drive roller 22*b* to turn, while additional transmission belt 36 turns intermediate shaft 38 through which power is transmitted via belt 40 to shaft 42 of drive roller 22*a*. Controls for adjusting the rate at which transmission belts 32 and 36 are driven, such as motor speed control, shown schematically as box 31, is operatively connected to motor 30. Motor speed control 31, separately or in conjunction with winch speed control 55 (also shown schematically), allows the rate of rolling and unrolling of the roll 24 to be gradually increased or decreased during starting and stopping. Such ramping of the rate of unrolling or rolling eliminates sudden jolts which may occur at start-up or stopping with the possibility of damaging the turf section 67 being manipulated or the apparatus itself. Motor speed control 31 and winch speed control 55 may be operatively connected to coordinate rolling and unrolling rates. Suitable speed controls 31 and 55 include any conventional means for continuously adjusting the rate of operation of an electrically driven motor, including speed reducers, servomotors or PIVs.

The powered support rollers and associated drive system just described are preferably located in storage pit 44 adjacent and below floor 20 in order to provide an out-of-the-way storage area for the activation system and roll 24. Said pit 44 is typically on the order of twelve feet wide and has a length typically slightly longer than the length of the surface to be covered. A liftable cover 46, having a support plate 43 and a cantilevered end section 47 which may be releasably locked into the upright and open position by at least one torsion arm assembly 78, is provided which may be lowered over pit 44 into seated position flush with floor 20 to temporarily close off the pit 44 and the components therein from the surroundings. The cover 46 may be lifted in its entirety to install the components of the system or to provide access to the system for servicing or removal. However, to wind or unwind the roll 24, the end section 47 only need be lifted and locked open by the torsion arm assembly 78 to provide an access to pit 44 through which spar 52 and the turf section 67 may pass during manipulation. Accordingly, end section 47 is preferably from about 1 to about 2 feet wide having a length perpendicular to FIG. 1 the length of cover 46. Cover 46 and end section 47 may also comprise a plurality of subsections (not shown) of the same width but of any convenient length, allowing the pit 44 to be accessed in discreet sections. Finally, in the preferred embodiment, the cover 46 is semi-permanently affixed, such as bolted, in the closed position after initial installation of the roll and apparatus to provide a more stable, continuous surface, while allowing access to the pit 44 through the unbolted end section 47. obviously, alternative storage locations for roll 24 and its turning system may be employed.

A plurality, for example four for each length of roll 24 of 30 to 35 feet, of rope-like members 48 are adapted to be detachably secured via suitable fasteners 50 to a spar in the form of fabric covered truss member 52. Said spar 52 may be permanently secured or removably secured (or a combination thereof) to the leading margin 54 of the artificial turf section 67 being applied over floor 20. Such removable securing may be accomplished, for example, through a sleeve (not shown) formed from the backing 14 of the turf. Members 48 are preferably formed of a material such as rope which will not scratch highly polished floor 20 when pulled across it during operation of the system, though such care need not be taken with other less delicate forms of support surfaces.

Figure 4:
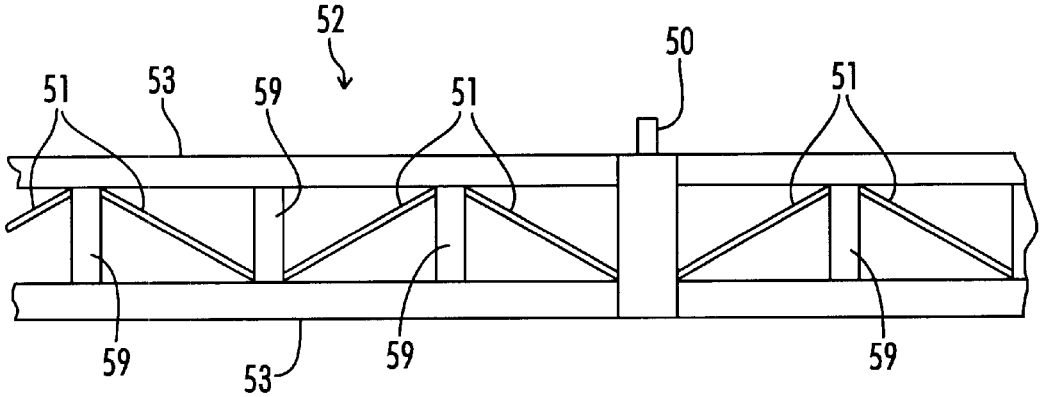
FIG. 4 is a top view of a spar according to the present invention.
Figure 5:
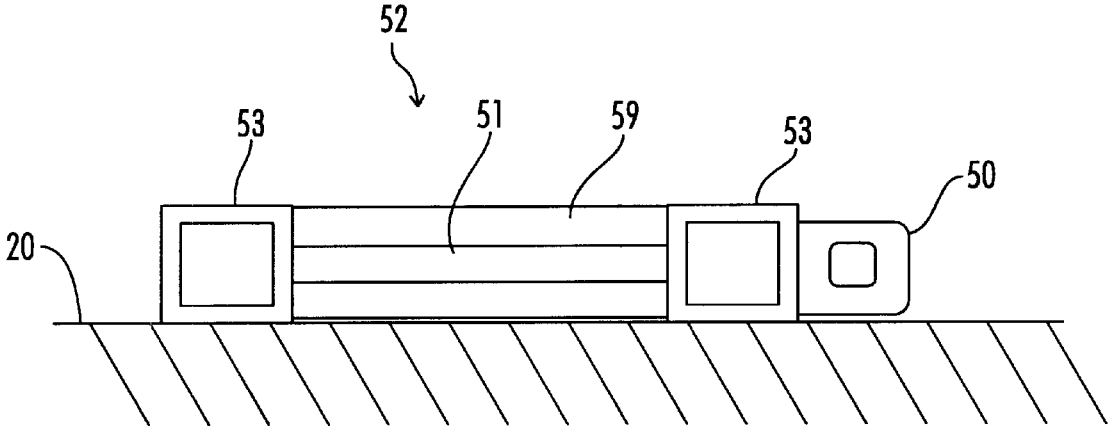
FIG. 5 is a side view of a spar according to the present invention.

As shown in FIGS. 4 and 5, truss member 52 is preferably in the form of a rectangular, dual tube 53 truss structure, said tubes 53 being joined by interconnecting struts 51 and beams 59. Truss member 52 is preferably formed of a stiff, relatively lightweight metal such as carbon steel, and may be assembled in a plurality of interlocking, removable sections as necessary or desired. A tubular truss member having this design is both lighter and stronger than previous wooden spars or spars fashioned of a single, rectangular metal tube.

Returning then to FIG. 1, winches 56 are provided for tensioning members 48, preferably in one or more sunken winch pits 57 on the other side of floor 20 from pit 44. Controls for adjusting the speed of winch 56, such as winch speed control, shown schematically as box 55, is operatively connected to winch 56. Alternative locations for such winches 56 and associated control 55 may be selected depending on layout preference. In the illustrated embodiment, one hydraulic winch 56 is provided for each rope 48 which is typically capable of exerting on the order of about 600 to about 1800 pounds pull of force thereon, though this will vary depending primarily on the weight of the turf section being moved.

As with pit 44, winch pits 57 are coverable with hinged lids 49 which may be lowered over pits 57 into seated position flush with floor 20 when winches 56 are not in use. Lids 49 also may be releasably locked into the upright and open position by at least one torsion arm assembly 78. As with cover 46, lid 49 may also be semi-permanently affixed in the closed position after initial installation having only a hinged end section (not shown) through which the winches may be accessed.

Figure 6:
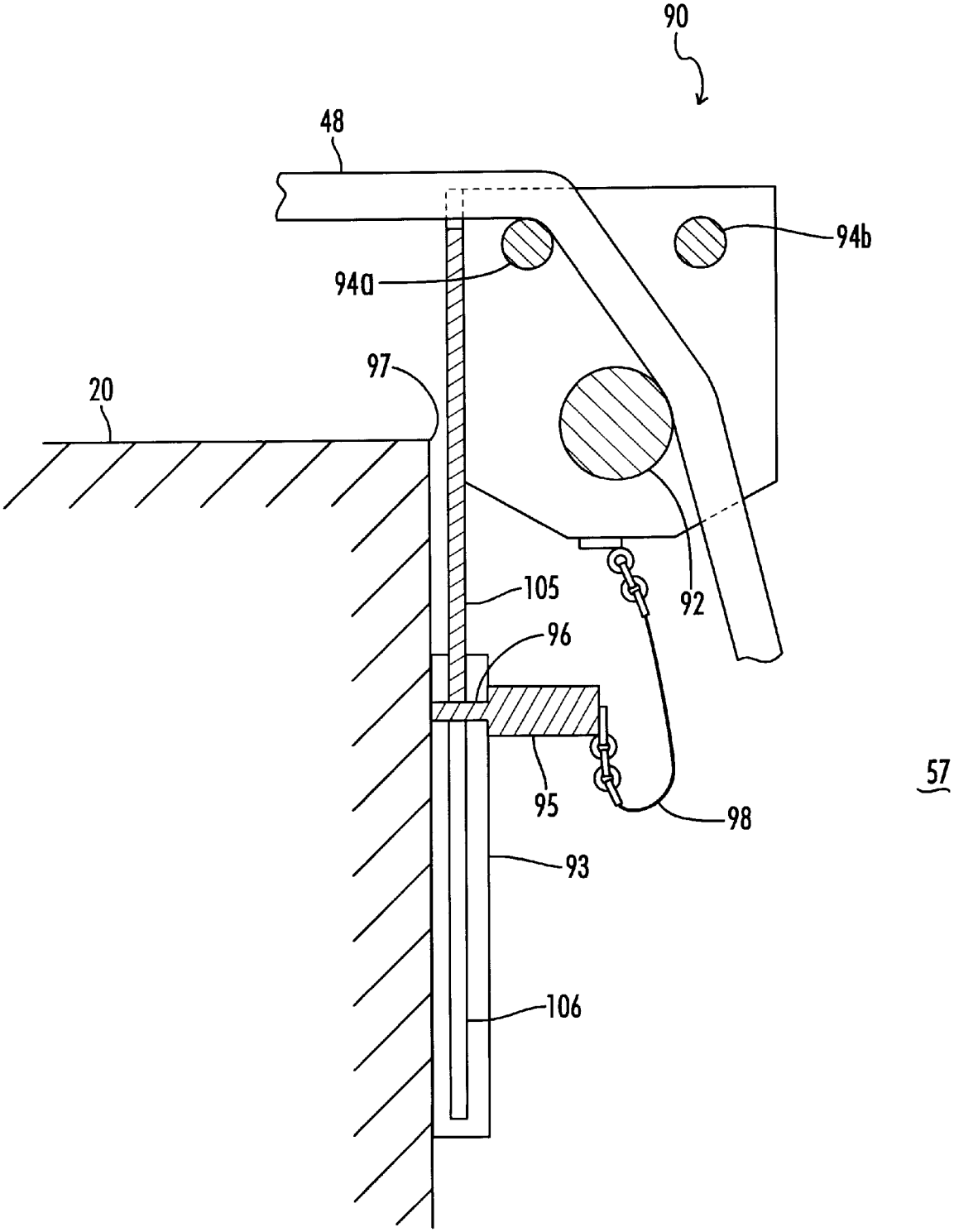
FIG. 6 is a cross-section view of a pop-up roller assembly according to the present invention.

In the present embodiment, pits 57 are fitted with protection for the associated member 48 from the damaging effects of friction with the edge 97 of the support surface 20 such as pop-up roller assembly 90. As shown in cross-section in FIG. 6, the preferred pop-up roller assembly 90 comprises a roller 92 and a pair of opposing rope guides 94*a* and 94*b* slidably connected by post 105 and groove 106 to plate 93 adjacent and below floor 20 within pit 57. When needed, lid 49 (not shown) is opened and roller assembly 90 is manually pulled up and secured with roller 92 positioned above the floor 20 by a locking device such as peg 95 and receiving hole 96 in plate 93. Peg 95 is preferably affixed to the roller assembly 90 by a flexible retainer, such as chain 98. Thus it can be seen that when member 48 is threaded between guides 94*a* and 94*b*, over roller 92, and affixed at either end to spar 52 and winch 56, member 48 is protected from contact across edge 97 of pit 57, thereby avoiding possible damage as it is pulled across the edge 97 during operation of winch 56.

Figure 7:
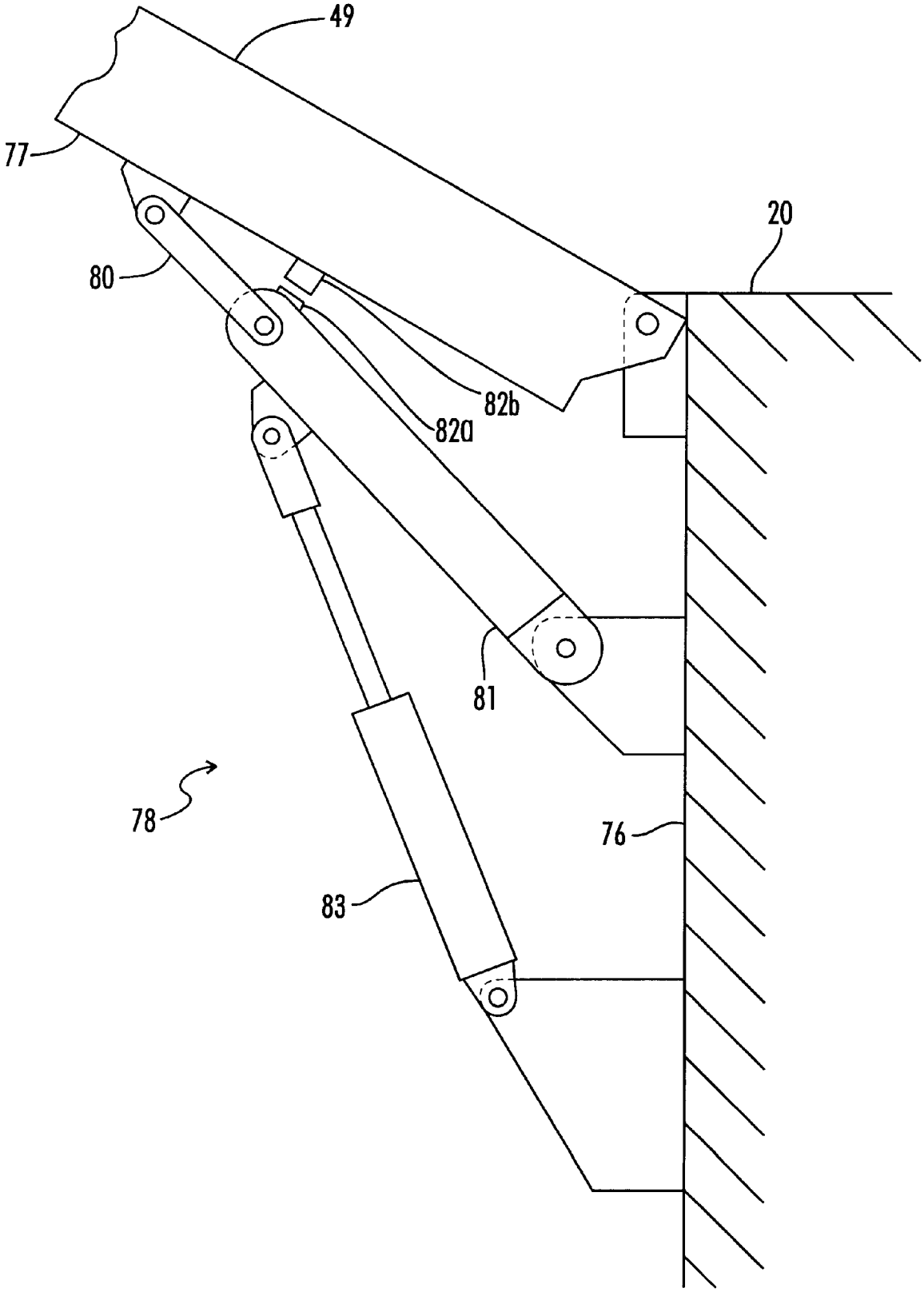
FIG. 7 is a side view of a torsion arm assembly according to the present invention.

FIG. 7 shows a torsion arm assembly 78 according to the present invention. The torsion arm assembly 78 comprises upper member 80 flexibly connected between lower side 77 of lid 49 and upper end of lower member 81 which, in turn, is flexibly connected adjacent to and below floor 20 on pit wall 76. Hydraulic member 83 is anteriorly connected to lower member 81 and pit wall 76. Opposing paired stoppers 82*a* and 82*b* are located on lower member 81 and lower side 77 of lid 49, respectively, such that when torsion arm assembly 78 is extended to its fullest upright extent, the upward force of hydraulic member 83 causes upper member 80 and lower member 81 to hyper-extend upward against the lid 49, such contact being buffered by stoppers 82*a* and 82*b*, thereby locking lid 49 open until the torsion arm is manually unlocked by lifting lid 49 slightly while pulling lower member 81 down such that lid 49 is allowed to close. Since the lids 49, 47 (FIG. 1) and covers 46 (FIG. 1) associated with the present invention can easily reach 160 to 360 feet in length or greater and must be sufficiently sturdy to support a wide range of traffic on the surface, including even vehicular traffic, lids can weigh hundreds and even thousands of pounds. Therefore, it is advantageous to employ hydraulics to aid in opening the lids while providing a self-locking mechanism such as torsion arm assembly 90 which will prevent the open lid from accidentally closing, even in the event of hydraulic failure.

Returning then to FIG. 1, pneumatic generator 58 for developing low pressure air underneath section 67 of artificial turf overlying the surface of floor 20 comprises at least one low pressure air blower (schematically illustrated at 60) connected to the underside of section 67 by means of a portable air transmission duct 104. Air transmission duct 104 may be in the form of a rigid duct inserted under the side margin of the turf (not shown) or, preferably, in the form of a flexible duct 102 joined to a removable duct panel 103 of turf, said panel being held in place by releasable, fastener such as hook and loop fasteners or zippers (not shown). Removable duct panel 103 is replaceable by an appropriately sized turf panel (not shown) when air transmission duct 104 is not needed.

Pneumatic generator 58 or permanent air transmission ducts (not shown) may be situated in a grate covered cavity (not shown) below ground level adjacent to and a few feet inwardly of sealing edge 64 of foundation 66 as described in the prior art. However, it has been found in practice that installation of such below ground air transmission systems adds significantly to the cost of the facility. Therefore, in the present invention, blower 60 preferably comprises one or more portable blowers located near the side margins (not shown) of the turf section being manipulated.

Plural apparatus assemblies of the kind just described may be provided as necessary for each roll of artificial turf being manipulated depending primarily on the size of support surface being covered. Operative interconnection of the various plural assemblies to minimize equipment components in a manner known to those skilled in the pneumatic arts are possible.

In operation, the method being described is for the purpose of manipulating large artificial turf section 67 with respect to floor 20, for example, in covering and uncovering such floor therewith. Section 67 in the illustrated embodiment is substantially rectangular in plain view when on the surface of floor 20, but using the invention described in U.S. Pat. No. 4,588,189, could be any shape, and in total comprises substantially the entire roll 24 of substantially-impervious, heavy duty artificial turf 10. After raising cantilevered end section 47 of cover 46, lid 49 of pit 57, and roller assemblies 90, ropes 48 are attached to spar 52 at a plurality of points in the plane perpendicular to FIG. 1, whereupon each winch 56 operatively secured to the opposite end of each rope 48 through roller assembly 90 is activated using winch speed control 55 to apply a pulling force on a rope 48 to thereby smoothly commence upwardly unwinding roll 24 out of pit 44. During such unwinding, the turf passes over idler roll 45 and the leading margin 54 is dragged across and covers the initial portion 68 of floor 20. Motor 30 is activated using motor speed control 31 to cause roll 24 comprising the remainder of the artificial turf section to turn which, with the continued, coordinated application of pulling forces on ropes 48, further advances turf section 67 across floor 20. Rotation of roll 24 occurs through frictional engagement between its periphery and the peripheries of drive rollers 22*a* and 22*b* on which roll 24 rests.

As more floor is covered, more stress is required to pull the heavy turf section up over rear sealing edge 64 and across the floor 20. When the friction between floor 20 and the heavy turf section becomes sufficiently high as to be difficult to pull much further via winch means 56, speed controls 33 and 55 are used to halt the feeding of section 67 while duct panels 103 are inserted into section 67 and connected via air transmission duct 102 to blower 60. Blower 60 is then activated to generate pneumatic pressure between floor 20 and the overlying section 67 of turf to thereby lift such section off floor 20 a finite clearance distance of about four inches or less. The operable pressure of the pneumatic cushion is that necessary to lift the turf. Such pressure will depend of the weight of the turf, and is usually on the order of about 0.10 to about 0.50 inches of water. In the illustrated raised position of FIG. 1, large section 67 of heavy duty, artificial turf is supported within its periphery on the pneumatic cushion in contactless overlying covering relationship above the surface of rigid floor 20.

Speed controls 31 and 55 are then used to smoothly apply pulling forces to the turf section 67. As the pulling forces on ropes 48 draw the large section further across floor 20, the air flotation of such section eliminates frictional resistance with the floor at any portion so lifted and in general minimizes such frictional resistance overall. In essence, the air supported portion of section 67 slides on the pneumatic cushion. Once the turf begins moving, the speed of unwinding may be varied as desired using motor speed control 31 in coordination with winch speed control 55.

During such floating support, however, the margins of section 67 along the four sides of the rectangular configuration are sealed in that the side margins (not shown) and leading margins 54 are engaged with the floor surface and the trailing margin with edge 64 in order to preserve the pneumatic cushion. This is accomplished along the trailing end of the advancing turf section via rubbing contact with sealing edge 64 and along the forward end via rubbing contact of spar 52 with floor 20. Sealing along the side margins parallel to the direction of unwinding and perpendicular to such leading and trailing ends may optionally be promoted by making such side margins heavier than the section supported on the air cushion via suitable perimeter weighting. For example, when the portion to be supported on air typically weighs between about 0.75 to about 1.75 pounds per square foot, the side margin portions comprising the area inward of the edge for about one foot could weigh between about 1.5 to about 2 pounds per square foot. Such increased weight can be provided by securing suitable flexible, planar weights capable of being wound up with the turf to the undersurface of the turf or by selectively increasing the density of the foam of resilient support pad 16 along such margins over the density inward of such margins. Complete sealing engagement of the margins with the support surface in the sense of no air escape occurring is not necessary, a slight flow being tolerable if the supporting air is replenished via one or more compressors or blowers 60. During covering of floor 20 after development of the floating support position of section 67 the forces exerted on the leading margin 54 should be substantially less than exerted thereon prior to development of such pneumatic cushion.

Pulling in the manner described continues until floor 20 is covered with the section 67 completely or to the extent desired, whereupon blower 60 is deactivated and, over a relatively brief time period, the air forming the cushion between the turf and floor exits through turf vent channels 18 or the space created when duct panel 103 is removed. This causes the section to gradually settle by gravity and collapse onto floor 20 whereupon, with the installation of replacement panels of turf (not shown) for duct panels 103, covering section 67 is ready for use, preferably after releasing ropes 48 from the leading margin.

The number and cross sectional size of channels 18 represents a balance between facilitating air escape over a relatively short period after covering and excess air loss during manipulation in the covering and uncovering phases. Such functional channels 18 are sufficiently small in opening individually as not to be noticeable except when the turf is closely examined in order not to detract from the pleasing appearance of the turf section. Alternatively, or in conjunction with channels 18, the air pressure can be dissipated merely by manually lifting the sides up from the floor or trampling on the covering section to force the air out through the seals or the space created when duct panel 103 is removed. Because of the reduced friction between the large expanse of floating section 67 and the underlying floor, the position of the large turf section on the floor can be easily manually adjusted while the pneumatic cushion is maintained, and as a matter of fact after the floor has been fully covered with the section but before relieving the pneumatic pressure, the entire section should be readily manually adjustable, for example to center or shift it about on the floor as required. Because of the nature of the air support system, wrinkles in the turf section are self-eliminating.

Once the floor 20 is covered with the section 67, in the preferred embodiment, spar 52 is laid into a shallow spar trench 100 located at the periphery of the fully extended turf and may be covered by lid 101. Alternately, spar 52 may be disconnected entirely from the leading edge 54 of turf section 67 for storage and, if desired, additional sections of turf (not shown) releasably but securely and seamlessly attached to the leading edge, such as with hook and loop fasteners or zippers.

To retract and wind section 67 up into roll 24, the procedure just described is reversed. Duct panels 103 are reinstalled and connected via flexible duct 102 to blower 60. Blower 60 is again activated and, after a short period to develop the air cushion under and lift section 67 within its margins off floor 20 to eliminate friction between floor and turf, speed control 31 is used to cause drive rollers 22*a* and 22*b* to turn in a clockwise direction to develop roll 24. Attachment of ropes 48 to spar 52 (and, if necessary, reattachment of spar 52 to leading margin 54 of turf) during wind up could promote guiding movement of the section back into a compact roll configuration with parallel edges of the roll layers. However, this function is primarily served in the present invention by paired thrust bearing blocks 75 which serve to guide turf back into a compact roll by preventing significant movement of core 70 during winding.

As during unrolling, surface friction between drive rollers 22*a* and 22*b* and the turf now causes the section to wind up into a roll of increasing diameter during removal from floor 20 while the pneumatic pressure is maintained. Winding is around floating steel core 70 to which trailing end 72 of the turf is attached. In the early stage of rewinding, if the relatively low weight of turf and core 70 is inadequate to develop sufficient friction with rollers 22*a* and 22*b* to allow winding to commence, it may be necessary to weight core 70, at least initially, for example, by filling it with water or other weight-providing material.

When duct panels 103 approach pit 44, the blower 60 is deactivated and the duct panels replaced with plain turf panels (not shown) prior to completion of winding. Spar 52 may conveniently be placed upon spar shelf 39 for storage and end section 47 and lids 49 and 101 closed to restore a continuous, smooth, rigid surface for alternative uses.

The invention is usable with any rigid support surface which is unyieldable in the sense of resisting any scraping displacement of its surface when the artificial turf section is dragged across it and which is relatively smooth and preferably planar at least adjacent its edges in order to minimize loss of air at the interface with the margins of the turf during application to and removal from such surface. In this sense, the support surface may be indoors or outdoors and be formed of cement, asphalt, wood or similar level material. Indoor installations are preferred to minimize the change in weight of the turf which is usually accentuated in outdoor applications.

The invention is usable with large artificial turf sections of sufficient expanse to avoid significant escape of the cushioning air out through the sealing regions between the surface being covered and the margins of the section when supported on the pneumatic cushion. While realizing that the sealing margins of the section may be adjusted in weight, narrow rolls in the direction of rolling and unrolling are usually undesirable in the invention from both the standpoint of wasteful cushioning air loss and the fact that the section may be sufficiently lightweight to be handleable without need for the system of the invention. Mindful of the foregoing, an entire athletic field of artificial turf, such as a football playing surface, on the one hand, down to sections on the order of about thirty to forty feet wide (along the length of the turf roll) of artificial turf weighing between about 0.20 to about 3.5 and preferably from about 0.4 to about 1.75 pounds per square foot, can be manipulated according to the invention. In the latter instance, the turf would be about 110 feet square and at 0.9 pounds per square foot, would weigh about 10,900 pounds.

While several embodiments of the present invention have been disclosed, it is to be understood by those skilled in the art that other forms can be adopted, all coming within the spirit of the invention and scope of the appended claims:

I claim:

1. An apparatus for removably covering a rigid, relatively smooth surface with a large section of substantially impervious, heavy duty artificial turf having a leading margin a trailing margin and at least two side margins comprising:

(a) at least one powered roller adapted to support and drive a roll of such artificial turf, said roll having a center shaft, said center shaft having two opposing ends;

(b) a pair of opposing thrust bearing blocks positioned adjacent each of said opposing ends of the center shaft to restrict horizontal movement of the center shaft during winding and unwinding;

(c) a thrust bearing attached to each opposed end of the center shaft, each thrust bearing having an attached wear plate allowing slidable contact against the associated thrust bearing block;

(d) a plurality of rope-like members secured to a leading margin of the roll;

(e) a winch for tensioning the members to unroll the artificial turf; and (f) a pneumatic generator for developing air pressure within the margins of the turf section wherein the margins are in sealing contact with the surface.

2. The apparatus of claim 1 wherein the pneumatic generator for developing air pressure within the margins comprises at least one low pressure air blower connected by at least one portable air transmission duct to the underside of the turf section.

3. The apparatus of claim 2 wherein the duct is removably fastened in the turf section.

4. The apparatus of claim 2 wherein the duct further comprises a rigid air transmission duct inserted under a margin of the turf section.

5. The apparatus of claim 1 wherein the rope-like members are detachably secured to a spar secured to the leading margin of the turf section.

6. The apparatus of claim 5 wherein the spar further comprises a dual tube truss structure, the tubes being joined by interconnecting struts and beams.

7. The apparatus of claim 1 further comprising a control for adjusting the rate of operation, said control being operatively connected to the powered roller.

8. The apparatus of claim 1 further comprising a control for adjusting the rate of operation, said control being operatively connected to the winch.

9. The apparatus of claim 1 wherein the powered roller, roll and thrust bearing blocks are located in a pit adjacent and below the smooth surface, the pit having a liftable cover, the cover having an end section which may be releasably locked into the upright and open position by a torsion arm assembly.

10. The apparatus of claim 1 wherein the winch is located in a winch pit adjacent and below the surface, the winch pit having a liftable lid which may be releasably locked into the upright and open position by a torsion arm assembly.

11. The apparatus of claim 10 wherein the winch pit further comprises protection means for the associated rope-like member from friction with the winch pit.

12. The apparatus of claim 11 wherein the protection means further comprises a pop-up roller assembly slidably connected to a plate adjacent and below the surface within the winch pit, the roller assembly further comprising a roller and a pair of opposing rope guides.

13. An apparatus for removably covering a rigid, relatively smooth surface with a large section of substantially impervious, heavy duty artificial turf having a leading margin, a trailing margin and at least two side margins comprising:

(a) at least one powered roller adapted to support and drive a roll of such artificial turf, said roll having two opposed ends;

(b) a plurality of rope-like members secured to the leading margin of the roll of the artificial turf;

(c) a winch for tensioning the members to unroll the artificial turf; and (d) a pneumatic generator for developing air pressure within the margins of the section wherein the margins are in sealing contact with the surface, the pneumatic generator comprising at least one low pressure air blower connected to the underside of the turf section by at least one portable air transmission duct joined to a duct panel releasably fastened within the margins of the turf section.

14. The apparatus of claim 13 wherein the roll has a center shaft having two opposing ends and wherein a pair of opposing thrust bearing blocks are positioned adjacent each of said opposing ends of the center shaft to prevent significant horizontal movement of the center shaft during winding and unwinding.

15. The apparatus of claim 14 wherein a thrust bearing is attached to each opposed end of the center shaft, each thrust bearing having an attached wear plate allowing slidable contact against the associated thrust bearing block.

16. The apparatus of claim 13 wherein the rope-like members are detachably secured to a spar secured to the leading margin of the artificial turf.

17. The apparatus of claim 16 wherein the spar further comprises a dual tube truss structure, the dual tubes being joined by interconnecting struts and beams.

18. The apparatus of claim 13 further comprising a control for adjusting the rate of operation, said control being operatively connected to the powered roller.

19. The apparatus of claim 13 further comprising a control for adjusting the rate of operation, said control being operatively connected to the winch.

20. The apparatus of claim 13 wherein the powered roller and roll are located in a pit adjacent and below the smooth surface, the pit having a liftable cover, the cover having an end section which may be releasably locked into the upright and open position by a torsion arm assembly.

21. The apparatus of claim 13 wherein the winch is located in a winch pit adjacent and below the smooth surface, the winch pit having a liftable lid which may be releasably locked into the upright and open position by a torsion arm assembly.

22. The apparatus of claim 21 wherein the winch pit further comprises protection for the associated rope-like member from friction with the winch pit.

23. An apparatus for removably covering a rigid, relatively smooth surface with a large section of substantially impervious, heavy duty artificial turf having a leading margin, a trailing margin and at least two side margins comprising:

(a) at least one powered roller adapted to support and drive a roll of such artificial turf, said roll having a center shaft, said center shaft having two opposed ends;

(b) a pair of opposing thrust bearing blocks positioned adjacent each opposed end of the center shaft to restrict horizontal movement of the roll during winding and unwinding;

(c) a plurality of rope-like members detachably secured to a spar secured to the leading margin of the artificial turf;

(d) a winch for tensioning the members to unroll the artificial turf;

(e) a pneumatic generator for developing air pressure within the margins of the turf section wherein the margins are in sealing contact with the surface, the pneumatic generator comprising at least one low pressure air blower connected to the underside of the turf section by at least one portable air transmission duct joined to a duct panel releasably fastened within the margins of the turf section;

(f) wherein the powered roller, roll and thrust bearing blocks are located in a pit adjacent and below the smooth surface, the pit having a liftable cover, the cover having an end section which may be releasably locked into the upright and open position by a torsion arm assembly;

(g) wherein the winch is located in a winch pit adjacent and below the smooth surface, the winch pit having a liftable lid which may be releasably locked into the upright and open position by a torsion arm assembly; and (h) wherein the winch pit further comprises protection for the associated rope-like member from friction with the winch pit.

24. The apparatus of claim 23 wherein a thrust bearing is attached to each opposed end of the center shaft, each thrust bearing having an attached wear plate allowing slidable contact against the associated thrust bearing block.

25. The apparatus of claim 23 wherein the spar further comprises a dual tube truss structure, the dual tubes being joined by interconnecting struts and beams.

26. A method of removably covering a rigid surface with a large section of substantially impervious, heavy duty artificial turf on a roll with an exposed leading margin and an outer surface which comprises:

(a) dragging the leading margin from the roll of artificial turf across an initial portion of the rigid surface by applying a pulling force at plural locations along the leading margin, wherein the roll is supported on a powered support roller;

(b) turning said roll of such artificial turf comprising the remainder of the artificial turf in place in an unwinding direction, while continuing the application of the pulling force to further advance the leading margin of the artificial turf across the surface, wherein the turning occurs via frictional contact between the outer surface of said roll of artificial turf and the powered support roller;

(c) connecting a pneumatic generator for developing air pressure to an underside of the unwound artificial turf defined by the leading margin having two opposed ends, a side margin proceeding from each of said opposed ends to the roll, and the roll connecting the two side margins, via at least one portable air transmission duct joined to a duct panel releasably fastened within the margins of the turf section;

(d) generating pneumatic pressure between the rigid surface and the overlying section of artificial turf to lift the overlying section within its margins off the rigid surface and minimize friction between the surface and the artificial turf, wherein the margins of the turf section over the surface are in sealing contact with the surface;

(e) continuing the application of pulling force while preventing significant horizontal movement of the roll upon the powered support roller until the floor is covered with the unwound artificial turf; and then (f) relieving the pneumatic pressure to permit the artificial turf where lifted to settle onto the surface.

27. A method of removing a large section of substantially impervious, heavy duty artificial turf, having a trailing margin and a leading margin and two opposed side margins, from a rigid surface which comprises:

(a) connecting a pneumatic generator to an underside of the artificial turf via at least one portable air transmission duct joined to a duct panel releasably fastened within the margins of the turf section;

(b) generating pneumatic pressure between the surface and the section of artificial turf to lift the section within its margins off the surface and minimize friction between the floor and the artificial turf, wherein the margins of the turf section over the surface are in sealing contact with the surface;

(c) winding the section up, beginning with the trailing margin, into a roll of increasing diameter wherein the roll is supported on a powered support roller and wherein the winding occurs via frictional contact between the periphery of said roll and the powered support roller, while maintaining the pneumatic pressure and preventing significant horizontal movement of the roll upon the powered support roller until the section is removed from the surface.

* * * * *